US007913887B1

(12) United States Patent
Siekaj

(10) Patent No.: US 7,913,887 B1
(45) Date of Patent: Mar. 29, 2011

(54) TILTING-CARRIAGE PINCHING SPOOLED MATERIAL DISPENSER

(76) Inventor: Witold Siekaj, Port Townsend, WA (US)

( * ) Notice: Subject to any disclaimer, the term of this patent is extended or adjusted under 35 U.S.C. 154(b) by 397 days.

(21) Appl. No.: 12/113,935

(22) Filed: May 1, 2008

Related U.S. Application Data

(60) Provisional application No. 60/915,374, filed on May 1, 2007.

(51) Int. Cl.
*B26F 3/02* (2006.01)

(52) U.S. Cl. ..... 225/70; 225/9; 225/14; 83/649; 242/588.6

(58) Field of Classification Search ..... 225/9, 14, 225/21, 23–24, 56, 57, 61, 63, 64, 66, 69, 225/70; 83/648, 649; 242/564.3, 571.8, 242/573.9, 586.3, 586.6, 588.1, 588.3, 588.6, 242/590, 595, 596.1, 597, 597.8; D19/69
See application file for complete search history.

(56) References Cited

U.S. PATENT DOCUMENTS

| | | | | | |
|---|---|---|---|---|---|
| 2,434,776 | A | * | 1/1948 | Van Cleef et al. | 225/21 |
| 2,506,504 | A | * | 5/1950 | Hudson | 225/21 |
| 2,574,175 | A | * | 11/1951 | Erhardt | 225/21 |
| 3,521,800 | A | | 7/1970 | Stephens | |
| 4,437,854 | A | | 3/1984 | Knoop | |
| 4,780,172 | A | | 10/1988 | Shea | |
| 6,152,344 | A | * | 11/2000 | Jensen | 225/12 |
| 6,170,726 | B1 | * | 1/2001 | Jensen | 225/12 |
| 2006/0151119 | A1 | | 7/2006 | Klauck | |

* cited by examiner

*Primary Examiner* — Edward Landrum
(74) *Attorney, Agent, or Firm* — Eric M. Hinkes

(57) ABSTRACT

An improved desktop tape and spooled material dispenser comprises a tilting-carriage and pinching assembly, which effectively presents the cut end of the tape, making it easy to grab, draw and cut a desired length of tape. In operation, as the exposed tape end is grabbed and drawn by the user, the carriage tilts forward, concurrently releasing pincers formerly retaining the tape. As the tape is drawn further forward and downward and placed against a novel V-shaped cutting blade, the pincers automatically close on the tape for effective shearing against the V-shaped cutting blade. The shearing of the tape releases the carriage to tip rearward, automatically closing the pincers, and effectively exposing and securing the end of the tape, thus presented for subsequent use. This invention is also intended for non-adhesive back rolled materials such as ribbon and string.

11 Claims, 10 Drawing Sheets

TILTING-CARRIAGE PINCHING SPOOLED MATERIAL DISPENSER

This application claims the benefit of U.S. Provisional Application No. 60/915,374 (filed May 1, 2007), which is incorporated by reference.

BACKGROUND OF INVENTION

1. Field of the Invention

This invention relates to an invention for dispensing conventionally-rolled adhesive tape or other spooled material such as ribbon or string; this invention focuses on the kind of dispenser, which is placed on a surface such as a desk or countertop, and accurately distributing a rolled or spooled material, which is typically drawn by hand from a cylindrical roller and severed to a desired length over a sharp cutting edge.

2. Description of Related Art

To draw a piece of spooled adhesive tape from a typical desktop dispenser, one typically grabs the tape with thumb and forefinger between a tape spool and a cutter blade, lifts the tape from the cutting blade, draws the tape outward and severs the tape over the cutting blade, leaving the remaining tape stuck to the cutting blade for subsequent use. In such an arrangement, the length of tape that can be procured is limited in that the user must grab the tape between the roll and cutting blade. Furthermore, the user must first unstick or dislodge the tape from the cutting block before drawing a desired length of tape. Lastly, a section of tape may be marked with a fingerprint.

SUMMARY OF INVENTION

The present invention is directed at a desktop tape or rolled material dispenser for use with a conventional tape roll or other non-adhesive backed rolled products. The present invention provides a tilting-carriage assembly, which effectively presents the cut end of the tape, making it easier in subsequent use to grab, draw and cut a desired length of tape.

The tilting-carriage tape dispenser features a pivoting carriage, which pivots in a forward and rearward direction and is mounted to a relatively heavy base. As the tape end is grabbed and drawn, the carriage tilts to the forward position, concurrently releasing pincers formerly retaining the tape.

The tape is drawn further forward and placed against a novel V-shaped cutting blade, as the pincers or tape guide pins close on the tape. The user then severs the tape against the V-shaped cutting blade, which releases the carriage to tip rearward, effectively freeing and exposing the end of the tape, held and presented by the now-closed pincers or tape guide pins for further use.

Conventional tape dispensers typically have provisions for holding a roll of tape with an axle though a mandrel onto which is mounted the tape roll. The disclosed invention retains the tape roll in a novel way, by means of a shifting retaining ring retained in a groove on the spindle, which as the tape roll is pushed onto the drum is automatically shifted to a place concentric with the spindle, allowing loading of the tape roll. After the tape is fully loaded onto the spindle, the retaining ring falls naturally to an offset position, effectively retaining the tape roll.

The mass of the unit, especially the feet of the base assembly provide stability that permit one-handed tape drawing. In other embodiments of the invention, some or all of the individual parts that comprise the assembly may be combined, reducing the number of parts, and made of other materials such as thermoplastic, in which the hinges and other points of flexion are achieved through flexible properties of the material, including integral hinges, snap fits and other retention methods common to flexible materials. Such variability of material would allow for manufacturing processes including injection molding.

The tilting carriage tape dispenser may have a variety of configurations or sizes, depending on the size and type of a tape roll. For instance, a larger tape roll would use a larger, heavier tilting-carriage tape dispenser, secured in place. This invention can also be used or non-adhesive backed spooled materials such as ribbon or flattened rope.

The present invention introduces such refinements. In its preferred embodiments, the present invention has several aspects or facets that can be used independently, although they are preferably employed together to optimize their benefits. All of the foregoing operational principles and advantages of the present invention will be more fully appreciated upon consideration of the following detailed description, with reference to the appended drawings.

PARTS LISTING

Figure 1:
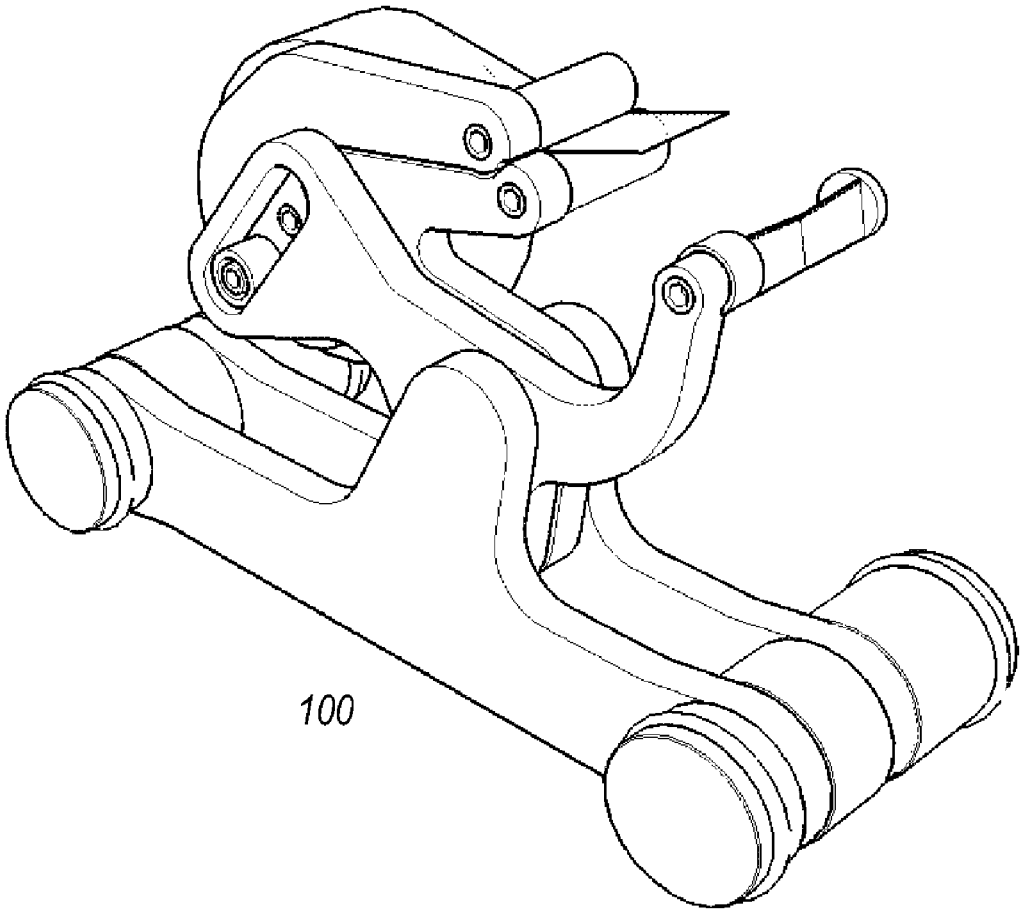
FIG. 1 is a perspective view of one preferred embodiment of the invention.
Figure 2:
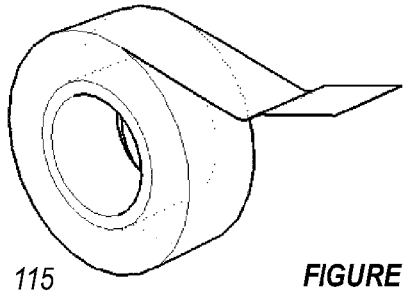
FIG. 2 is a perspective view of a spool of tape or other rollable material.
Figure 3:
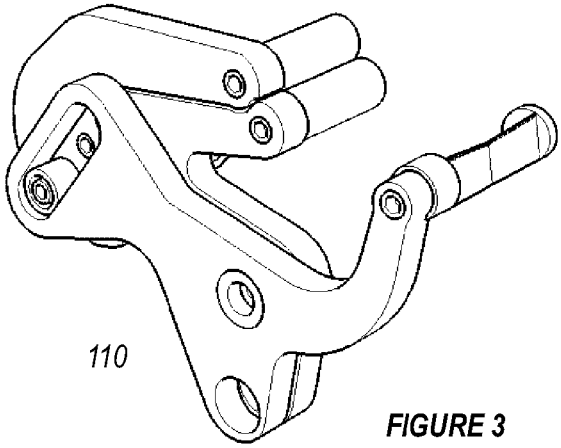
FIG. 3 is a perspective view of one preferred embodiment of the carriage assembly of the invention.
Figure 4:
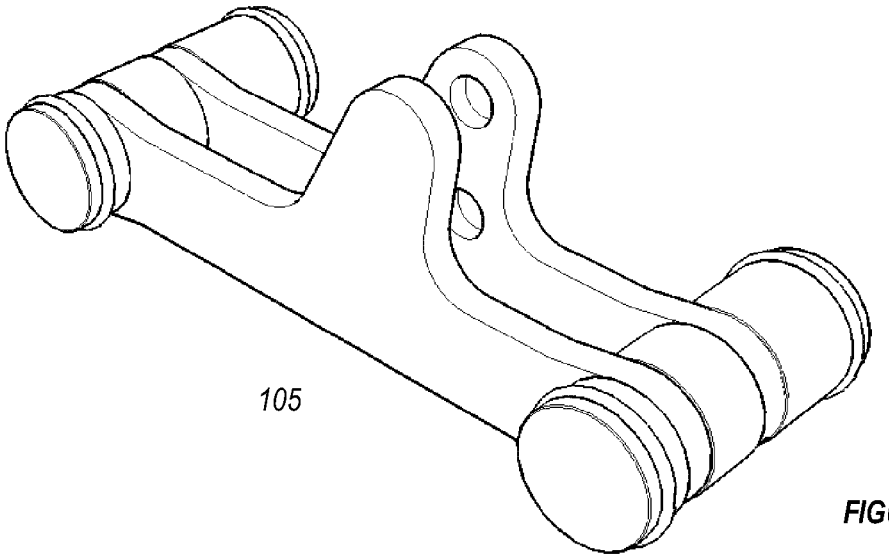
FIG. 4 is a perspective view of one preferred embodiment of the base assembly of the invention.
Figure 5:
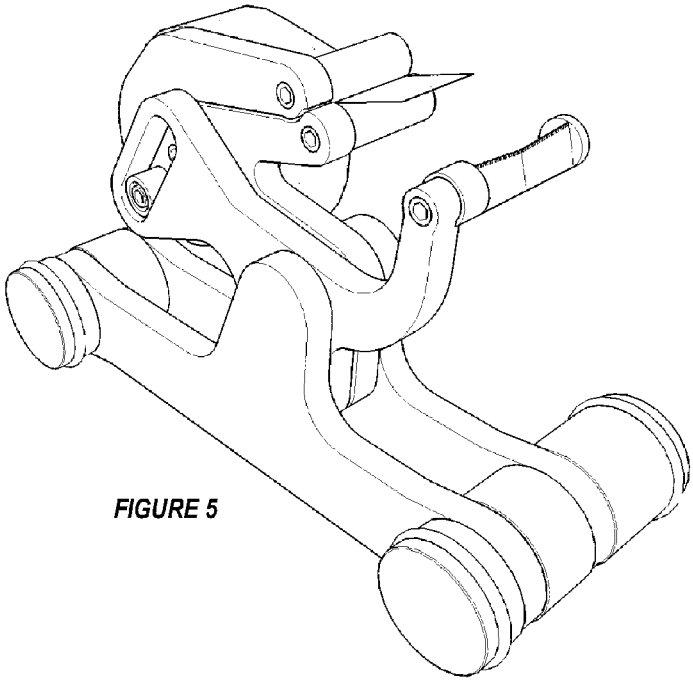
FIG. 5 is a perspective view of one preferred embodiment of the invention.
Figure 6:
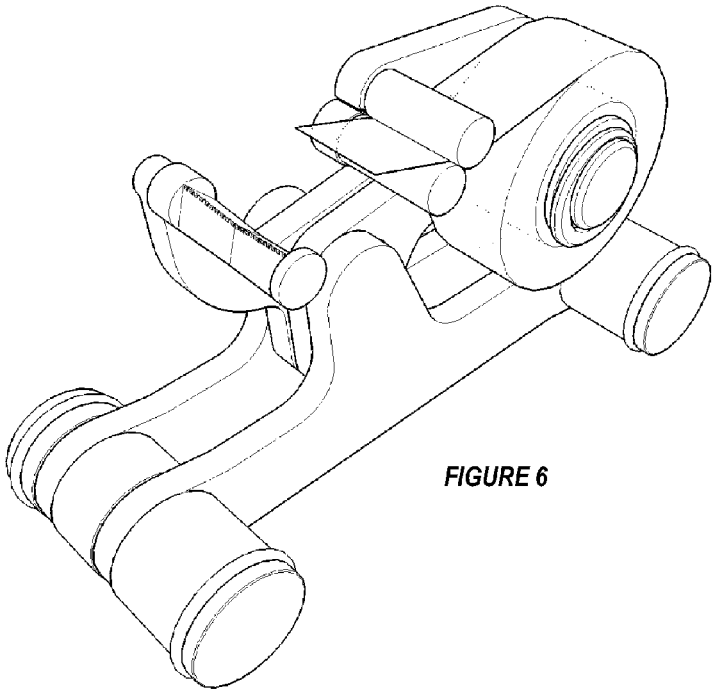
FIG. 6 is another perspective view of one embodiment of the invention.
Figure 7:
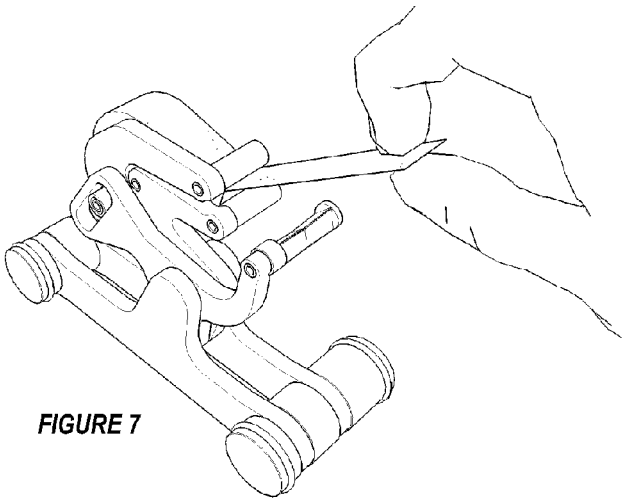
FIG. 7 shows use of the tilting carriage tape dispenser, wherein a user is grabbing an end of adhesive-backed tape or other spoolable material from said dispenser and pulling the tape end forward, thereby tilting the carriage assembly upward and forward, automatically opening pincers as the tape is drawn.
Figure 8:
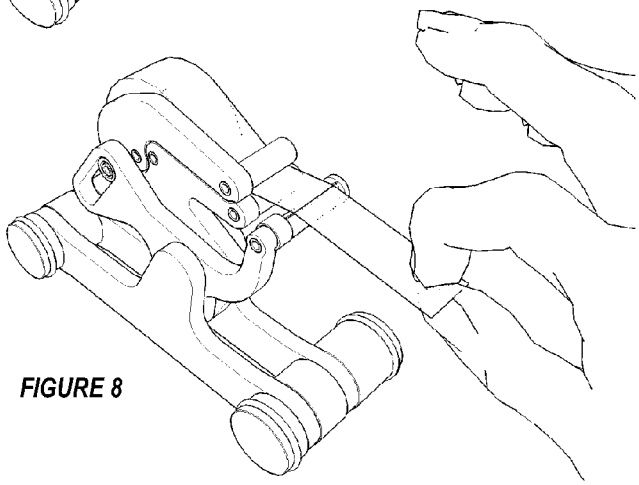
FIG. 8 shows a user, having drawn the desired length of tape, placing the tape across a cutter blade. As the pincer assembly or the upper and lower carriage arms tilts downward, the pincers closes on the tape, holding it fast as the tape touches the cutter edge; note also the bearing of the upper carriage arm reaches a terminal end of the third opening on the cutter arm.
Figure 9:
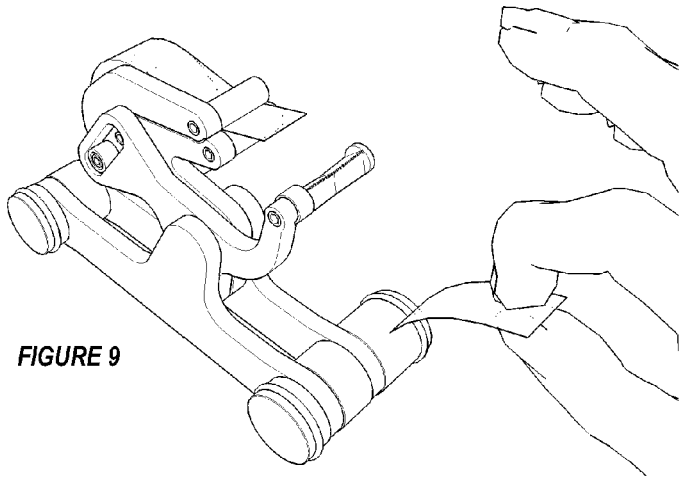
FIG. 9 shows after a user finished shearing a desired length of tape, the upper and lower carriage arms are able to rock rearward to a resting position and presents the exposed tape end to subsequent use.

100 apparatus for dispensing and cutting a spooled material with a single hand
105 base assembly
110 carriage assembly
115 spoolable material or tape or ribbon
Base Assembly
200 first base bracket
205 second base bracket
210 first bracket end
220 second bracket end
225 center bracket area
230 arm portion
235 first arm blind hole
240 second arm blind hole
255 long foot
260 short foot
265 O-ring or structure for gripping a surface under the base
270 Screws
275 spacers
Carriage Assembly
300 Upper arm or first/upper carriage arm
305 first upper carriage arm end
310 second upper carriage arm end
315 bearing or rotatable bearing
320 upper or first tape guide or guide pin
400 Lower arm or second/lower carriage arm
405 first lower carriage arm end
410 second lower carriage arm end
415 center lower carriage arm end
420 first lower carriage arm opening
425 second lower carriage arm opening
430 lower or second tape guide or guide pin
500 Cutter Arm
505 first cutter arm end
510 second cutter arm end
515 cutting blade is connected to the first cutter arm end
520 first cutter arm opening or hole
525 second cutter arm end opening or hole
530 third cutter arm opening or hole
560 upper or first connection pin
565 lower or second connection pin
570 drum
575 drum shaft
580 groove on drum shaft
585 ring to slidably and rotatably engage the drum shaft

DESCRIPTION OF PREFERRED EMBODIMENTS

Referring to the attached figures, there is an apparatus 100 for dispensing and cutting a spooled material 115 with a single hand of a user, which comprises a base assembly 105 and a carriage assembly 110. In the simplest version, the carriage and the base assemblies are singular pieces that interact from a first resting position to a second intermediate position and then to a third cutting position. In supplied FIGS. 1-22, one preferred version has a combination of different parts for the carriage and the base assemblies.

Base Assembly

Figure 10:
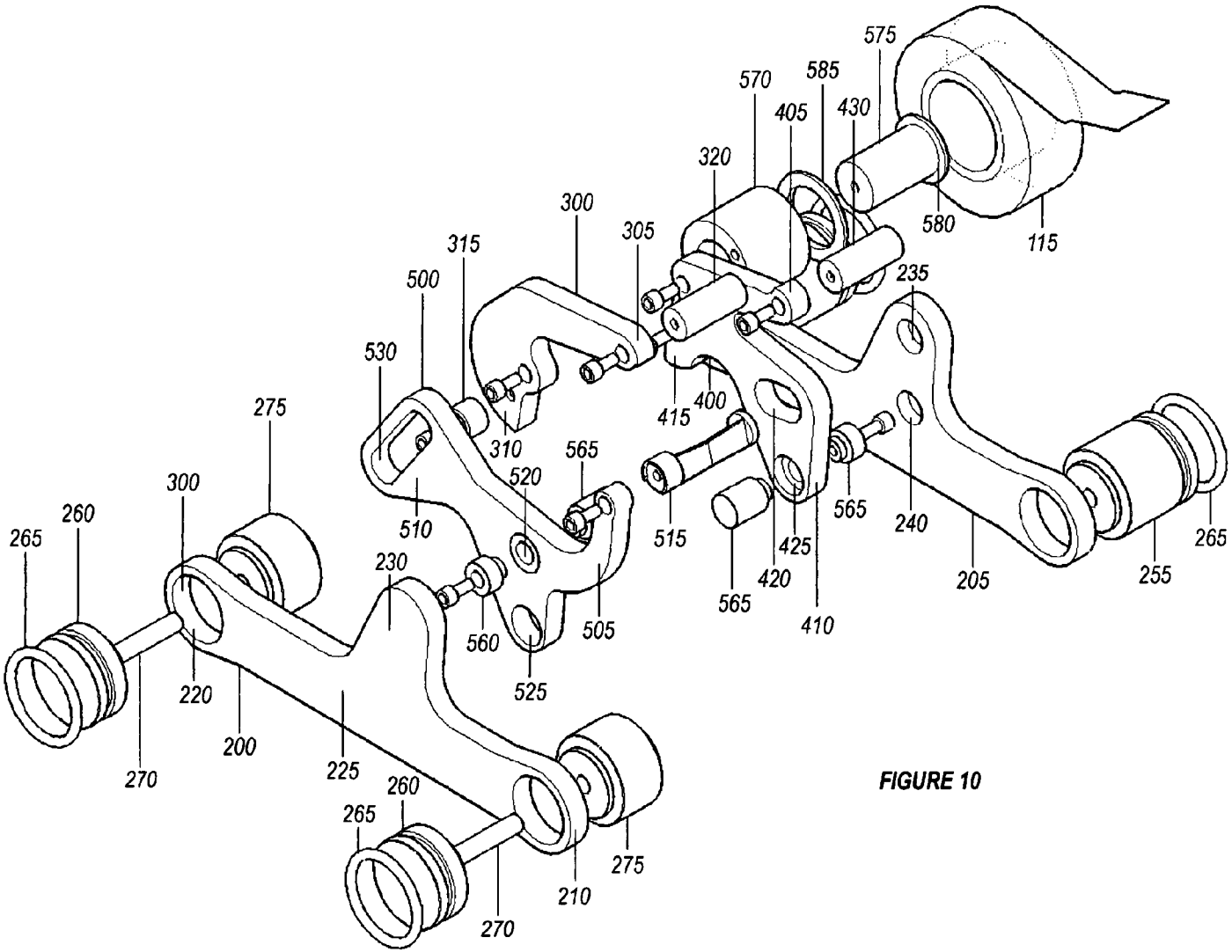
FIG. 10 is an exploded view of the parts making up an embodiment of the dispenser apparatus.
Figure 11:
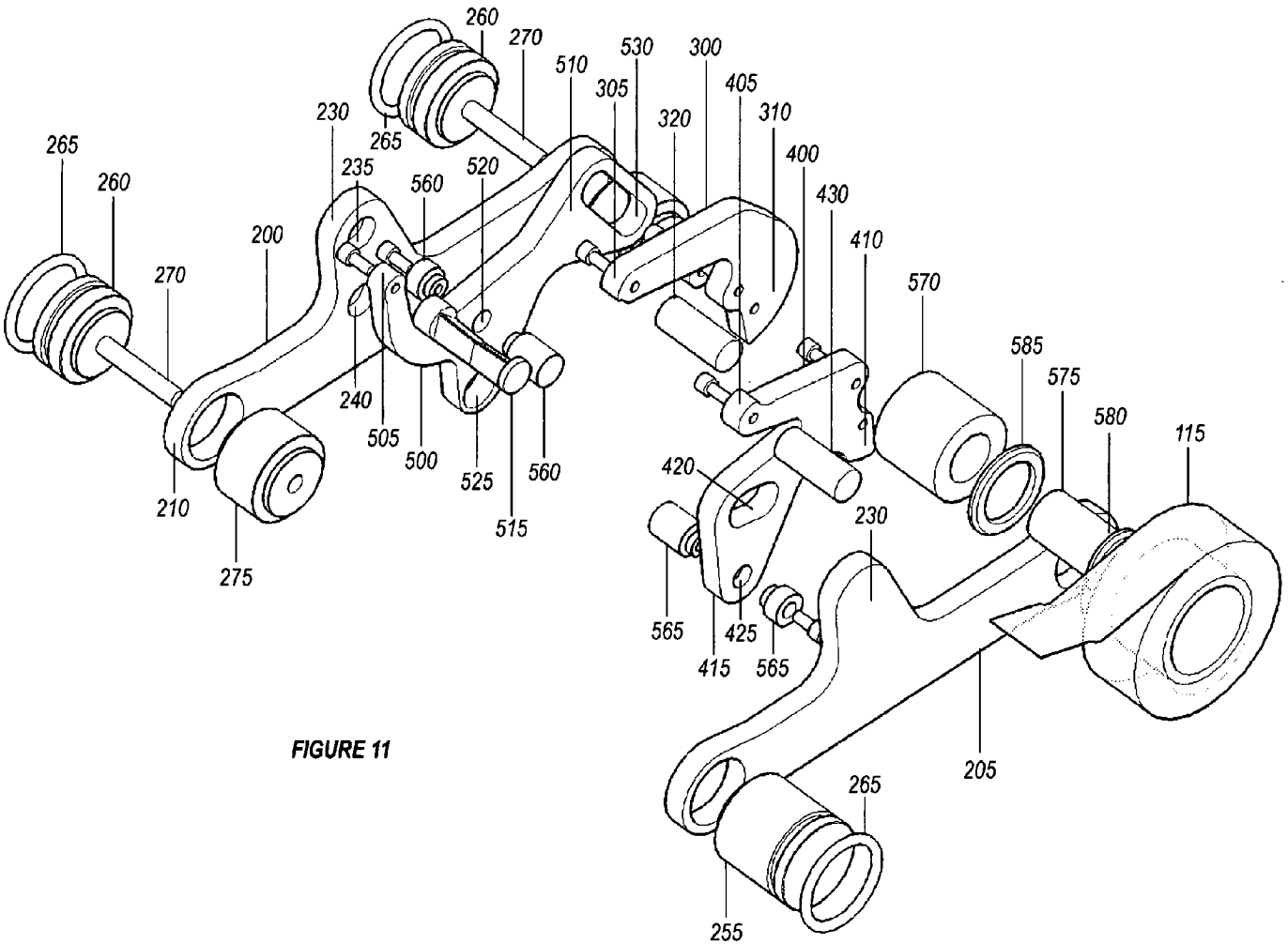
FIG. 11 is another exploded view of the parts making up an embodiment of the dispenser apparatus.
Figure 12:
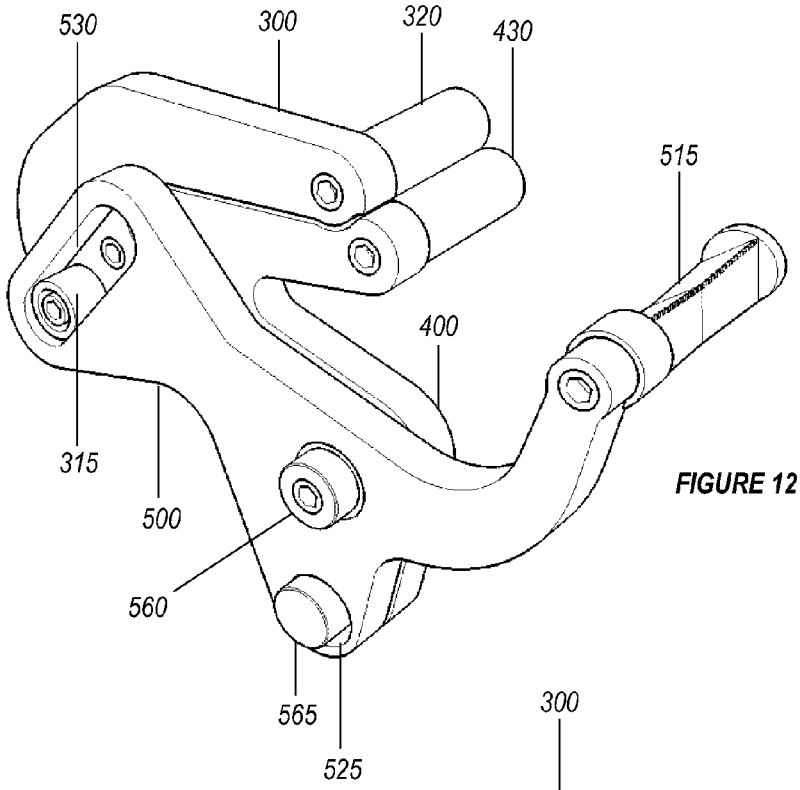
FIG. 12 is a first view of the upper and lower carriage arms and the cutter arm.
Figure 13:
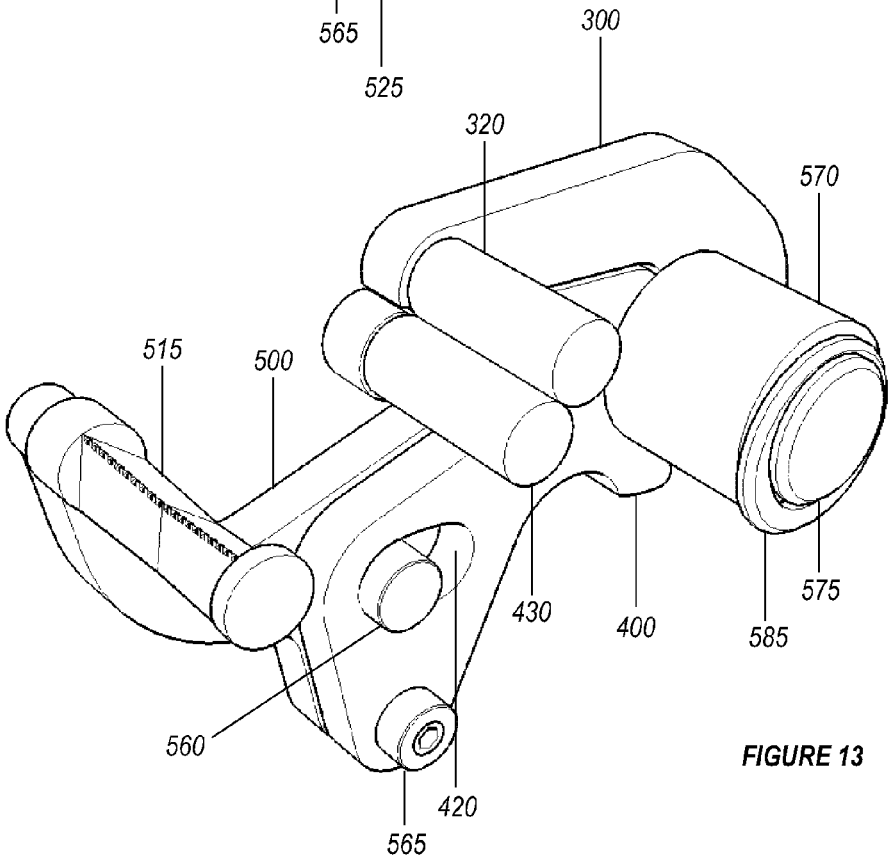
FIG. 13 is a second view of the upper and lower carriage arms and the cutter arm.
Figure 14:
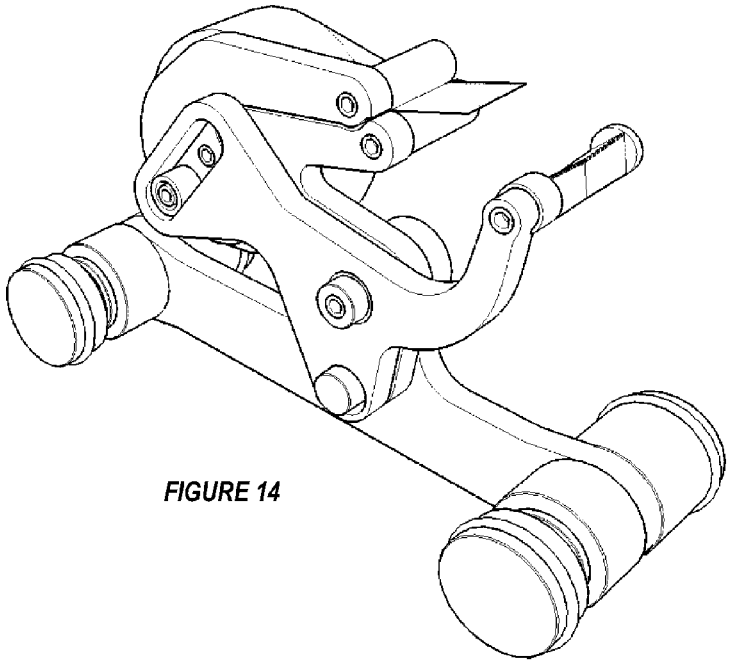
FIG. 14 shows the apparatus with one of the base brackets removed to expose the internal carriage assembly structure.
Figure 15:
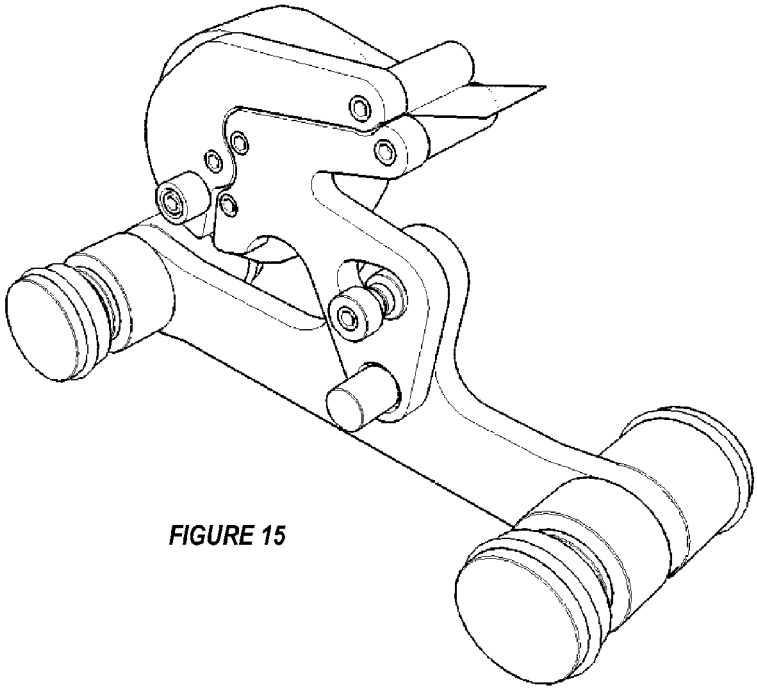
FIG. 15 shows the apparatus with one of the base brackets removed and also the cutter arm removed to expose the engagement of the upper and the lower carriage arms.
Figure 16:
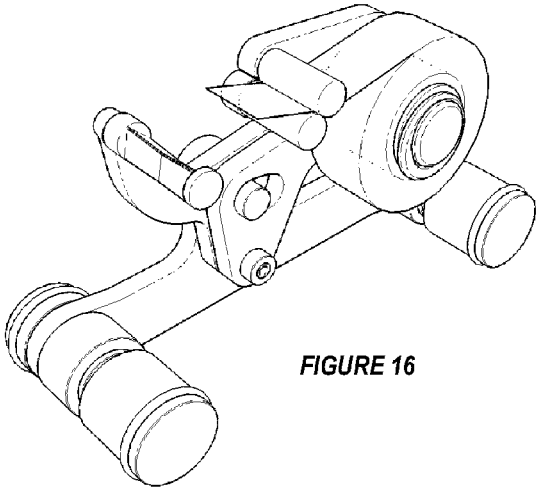
FIG. 16 shows the apparatus with one of the base brackets removed to expose the internal carriage assembly structure.
Figure 17:
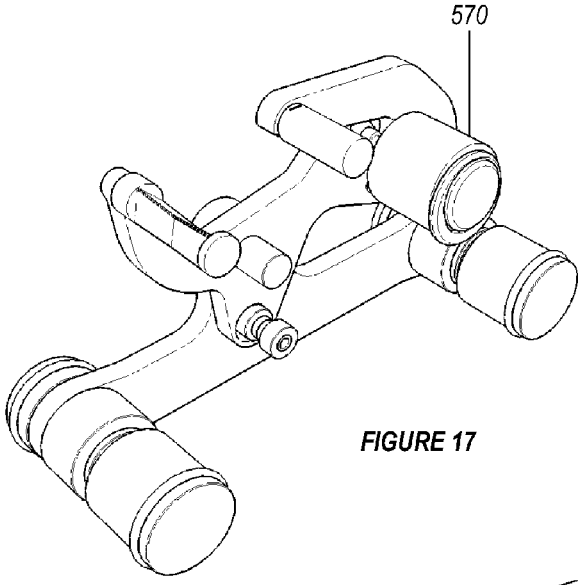
FIG. 17 shows the apparatus with one of the base brackets removed and the lower carriage arm removed.
Figure 18:
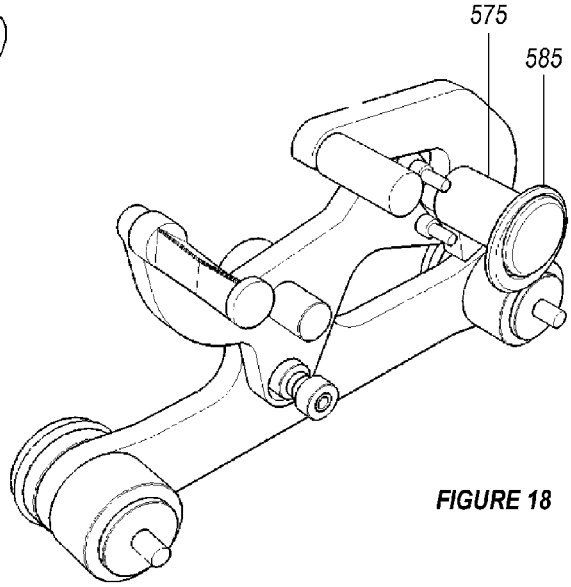
FIG. 18 shows the apparatus with one of the base brackets removed and the lower carriage arm removed; note that the drum is removed to expose the drum shaft.
Figure 19:
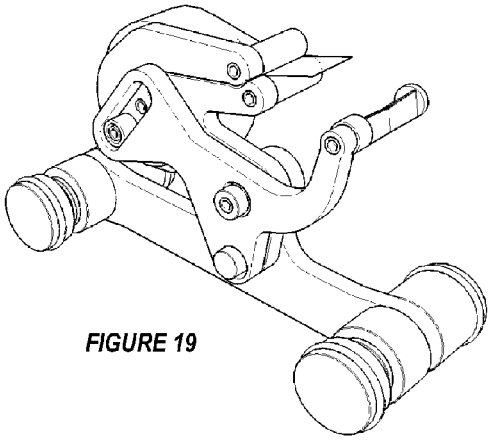
FIGS. 19-22 show views of the apparatus minus one base bracket to show the carriage motion during operation of the apparatus (a first resting position; a second or intermediate position; a third cutting position).
Figure 20:
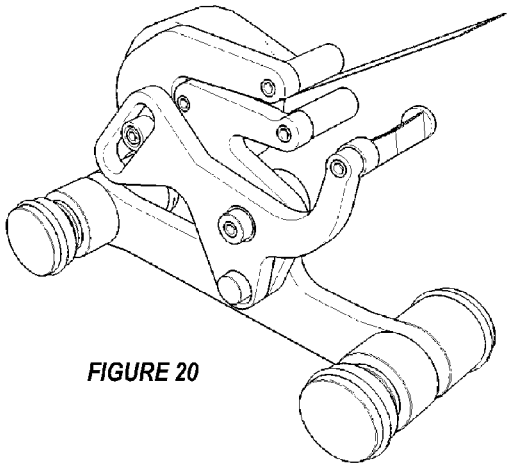
Figure 21:
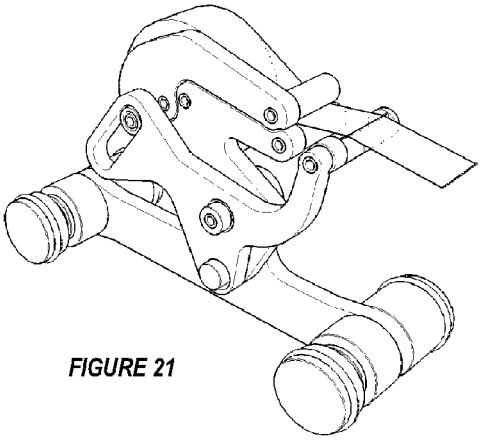
Figure 22:
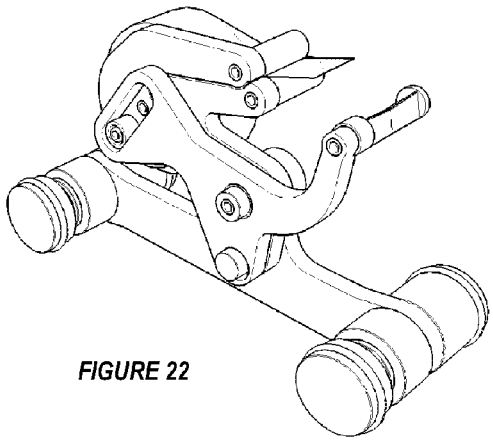

Viewing the exploded views in FIGS. 10 and 11, the base assembly 105 consists of a first base bracket 200 and a second base bracket 205; these brackets are separated by spacers 275 with one spacer at each end of the base bracket legs. The brackets can mirror each other or be different shapes.

The each first and second base bracket has a first end 210 and a second end 220 and a central bracket area 225. Approximately near the center of the base bracket is an arm 230 or a portion for holding the carriage assembly. This carriage holder portion or arm 230 can arise approximately perpendicular to the plane of the base. The bracket arm surface can have grooves, holes or blind holes (230 and 240), which correspond to a lower pin 565 and an upper pin 560 to connect to the carriage assembly components.

Each bracket can have at least one foot or spacer. In the preferred embodiment, extending from the end of each leg of the first base bracket are two long feet 255. Extending from the end of each leg of the second base bracket are two short feet 260. Each of said four feet is circumvented by O-ring structure 265, which provides a tacky surface to prevent skidding of the base assembly on a surface such as a desktop or table; this O-ring is one type of structure to grip a surface under the base assembly. Other gripping materials would include rubber or gripping layers.

The base assembly can be one unitary piece or use a single bracket, but the base assembly of the first preferred embodiment comprises multiple brackets, multiple foot structures, O-rings, and spacers, and is held together by screws or other attachment devices, which run or pass through the short feet and the respective second base bracket, through the spacers, through the first base bracket and threading into the long feet.

Carriage Assembly

Retained and being able to pivoting forward and rearward in the base assembly, there is a carriage or pincher assembly 110. This carriage or pincher assembly is comprised of first or upper carriage arm 300 and a second or lower carriage arm 400 and a cutter arm 500. The upper and lower arms have the greatest ability to pivot forward and rearward in relation to the base assembly. The cutter arm can have some ability to move forward and backwards to help in pinching or grasping the tape. Other embodiments allow the cutter arm to be stationary with the base or base assembly.

Upper Carriage Arm:

The upper carriage arm 300 has a first upper carriage arm end 305 and a second upper carriage arm end 310; a bearing 315 is connected to the second upper carriage arm end 305; an upper of first tape guide 320 is connected to the first upper carriage arm end 310. The first end 305 of the upper carriage arm is generally elongated in shape. The upper and lower arms can have holes accept screws or pins. The bearing can be connected to the upper arm with a shoulder screw.

Lower Carriage Arm:

The lower carriage arm 400 has a first lower carriage arm end 405 and a second lower carriage arm end 410 and a center lower carriage arm end 415.

The second lower carriage arm has a first lower carriage arm opening 420 and a second lower carriage arm opening 425; the second lower carriage arm end opening 425 is located closer to second lower carriage arm end 410; the first opening 420 of the lower carriage arm is located in between the center lower carriage arm end 415 and the second lower carriage arm end 410; the first lower carriage arm end opening 420 is larger than or oversized compared to the second lower carriage arm opening 425. The elongated size and shape of first lower carriage arm opening 420 help the carriage assembly to move back and forth with respect to the base.

Engagement Areas of the Upper and Lower Carriage Arms:

Viewing the FIGS. 15 and 19-22, the second end 310 of the upper carriage arm has a male type attachment structure, engagement area or bump or boss, which enables the upper arm to contact and to engage the central portion 415 of the lower carriage arm. The central portion 415 of the lower carriage arm has a female type attachment structure, engagement area, indentation, groove or bay, which conforms to engage the male type engagement area of the upper arm.

This type of engagement structure on the upper and lower arms allow two kinds of movements: (1) to allow the upper and lower arms to move together when the entire carriage assembly moves forward and towards the cutting position; and (2) to help the upper and lower arms to slightly disengage when the user first grasps the tape end.

Note in other embodiments, it may also be possible to use other types of engagement structures or to switch the male and female portions on the lower and upper arms.

Cutter Arm:

There is a cutter arm structure 500, which has a first cutter arm end 505 and a second cutter arm end 510. A cutting blade 515 is connected to the first cutter arm end 505; the preferred embodiment uses a V-shaped cutting blade, with the center of the cutting edge being lower than its respective ends. Other shaped blades can be used.

The cutter arm 500 has a first opening 520, a second opening 525 and a third opening 530; the first and the second openings of the cutter arm are located between the first and second ends of the cutter arm; the third opening 530 of the cutter arm is located at the second end of the cutter arm and has a substantially larger opening than the first cutter arm end opening and is able to allow the rotatable bearing 315 of the upper carriage arm 300 to slidably engage within the third cutter arm opening 530. In the preferred embodiment, this third opening has an elongated shape and is slanted at an angle to help the up and down movement of the carriage assembly.

The first end of the cutter arm is generally elongated and curves away from the central portion of the cutter arm; other embodiments may allow for a straighter arm instead of this elongated shape; the elongated shape of the first end of the cutter arm can be adjusted to align the cutting blade with the tape or spooled material as the material is moved from the guides, but the comparative height of the guides and the cutting arm at the time of cutting is not intended to limit this invention.

In conjunction with the oversized first opening 420 on the lower carriage arm, the slotted shape of the third opening 530 of the cutter arm allows the lower and upper carriage arms to move forward and backwards and angularly around a pivot point (lower or second pin 565), which also allows for some movement up and down (height). In the resting position, the lower and upper carriage arms are at a lower elevation than when the lower and upper carriage arms are in the intermediate position during use of the apparatus.

Tape guide pins or pincers (320 and 430) are secured to at least one end of each of the first carriage arm and the second carriage arm. The first arm 300, second arm 400, and cutting arm 500 of the carriage assembly 110 together comprise a sub-assembly that creates a pinching action in which the tape pins open and close on the tape or spooled material, as the carriage assembly moves forward and rearward.

Upper and Lower Connection Pins

There is a first or upper connection pin 560 and a second or lower connection pin 565 to help connect the carriage assembly 110 to the base assembly 105. The lower pin 565 engages the second arm blind hole 240 on each of the base brackets and the second opening 525 of the cutter arm and the second opening 425 of the lower carriage arm; the upper pin 560 engages the first arm blind hole 235 on each of the base brackets and passes through the first opening 520 of the cutter arm and slidably engages the first opening 420 of the lower carriage arm.

Drum and Drum Shaft

To help connect the spoolable or rolled material or tape to the apparatus, there is a drum 570 and a drum shaft 575, which engage the carriage assembly. The drum 570 and drum shaft 575 comprise a drum assembly, which is to be loaded with a roll of tape or other rolled material 115.

The drum shaft 575 is connected to the upper carriage arm 300; the drum shaft lies within the drum; the drum is mounted to the center part of the lower carriage arm 400; the spooled material engages the drum; the spooled material passes through the upper guide 320 and the lower guide 430; the cutter arm 500 is mounted to the base assembly; the base assembly and the carriage assembly being engaged so that the upper and the lower carriage arms move independently of the base assembly; the first opening of the lower carriage arm and the third opening of the cutter arm help said upper and lower carriage arms to move independently of the base assembly.

Attached to the first or upper carriage arm is the drum shaft 575, which is contained within drum 570. The drum 570 is mounted to the lower or second carriage arm 400; this structural arrangement allows drum shaft 575 to act as an axle for the upper arm 300, and the upper arm 300 can pivot about the drum 570 in relation to the lower arm 400 and thus provides a hinge for the tape guide pins to open and close on the tape. To help keep the followed material on the drum assembly, the drum shaft has a peripheral groove 580, which contains a ring 585, which can shift in the groove in a manner allowing both tape roll loading and tape roll retention.

Movement of the Carriage Assembly

The second carriage arm pivots forward and rearward on lower pivot pin, which is retained between first and second base brackets. The cutter arm is held between the base brackets via the first or upper pivot pin, and the motion of the cutter arm is limited by the second or lower pivot pin. The cutter arm contains a slot guide (third opening of the cutter arm), within which slides a bearing, which is affixed to the first cutting arm. The bearing thus effectively pushes the first arm down against the second arm and helps close the respective tape guide pins on the tape, when the carriage is at rest and in its forward position.

Because of the coordinated movement of both the upper and lower carriage arms (along both the third opening of the cutter arm and the second connection pin), there is not only movement forward and backward, but also angular movement around the pivot point of the second connection pin.

The arrangement of the tilting carriage regulates the opening and closing of the pincer assembly by pinching the tape between tape guide pins when the carriage assembly is tipped to its rearward position.

As the tape is drawn forward, the carriage assembly tips forward, and the pincers slightly separate and release the tape; as the tape is placed on the cutter blade, the pincers close on the tape and remain closed and thus secure the tape as it is sheared; the tape remains secured by the pincers as the carriage tips back to the rearward position, thus presenting the tape end for subsequent use.

Some additional notes on how the carriage assembly works: the cutting arm helps close the upper arm. The bearing that rides in the cutting arm slot does not close upper arm, but movement of the bearing within the slot on the third opening of the cutter arm helps the carriage assembly to move up and down.

In the preferred embodiment, the cutting arm is not stationary, but rather rocks just enough to help pinch the tape. The first hole on the cutter arm is oversized to allow movement around the first pin. In addition, when you first draw the tape, the pinchers open, there is a slight motion of the cutting arm. Note that other embodiments allow for a stationary cutting arm.

In the act of shearing the tape, the cutting arm tilts forward a bit and applies pressure on the bearing, which makes the upper arm rock clockwise or forward, which drives the upper guide down toward the lower guide, thus pinching the tape.

Carriage Motion:

1. First or Resting Position:

In the first or resting position, the upper and lower carriage arms are engaged and the guide pins on the ends of the carriage arms contact both sides of the tape end; the bearing on the upper carriage arm is in the lowest position within the third opening on the cutter arm; within the first opening on the cutter arm, the first guide pin contacts the first or front of the first opening of the cutter arm. Note in the resting position, the weight and the structures of the carriage assembly (third opening on the cutter arm and the oversized first hole on the lower carriage arm) help push the carriage assembly rearward toward this first or resting position.

2. Intermediate Position as the User Pulls and Applies Force to the Tape End:

In the at least one intermediate position, the user grasps the end of the tape with two fingers of one hand and causes an upward force on the upper tape guide on the upper carriage arm. This pulling of the tape end causes the guide pins and the carriage arms to disengage. With this applied force of grasping the tape, the upper carriage arm rotates slightly backwards.

This disengagement of the carriage arms and the tape guides is possible due to the ability of the male/female engagement area between the carriage arms to allow for a measured movement. This male/female engagement area allows the tape guides to disengage even when the upper and lower arms collectively are moving to a forward position. Then, as forward motion continues, this same structure allows the tapes guides to reengage and pinch the tape.

At the same time as the user grasps the end of the tape, the entire carriage moves forward due to the force applied to the upper carriage arm, which in turn pulls the attached bearing upward and forward within the third opening or elongated slot of the cutter arm. The male/female engagement areas of the upper and lower arms also help in pulling the carriage assembly forward. In some embodiments, the cutter arm moves some, but not as much the upper and lower carriage arms.

At the same time as the user grasps the end of the tape, there is also movement within the first opening of the lower carriage arm; because the first opening of the lower carriage arm is oversized and larger than the internally placed first pin, the carriage assembly is able to have some measured movement around the axis of the lower pin during the intermediate phase.

3. Intermediate Continued—as Tape Approaches the Cutting Blade:

As the user continues to pull the tape and towards the cutting blade, the slight downward force of moving the tape towards the cutting blade:

Greatly reduces or eliminates the upward force on the upper guide on the upper carriage arm;

Causes the upper arm to lower and move forward with the carriage to re-engage the lower arm;

Causes both tape guide pins to begin to contact or to pinch the tape again;

Causes the bearing to continue upward and forward within the third opening or elongated slot of the cutter arm; and Causes the carriage assembly to continue to move forward and to get closer and closer towards and touch the rear or second end of the first opening of the lower carriage arm (with the first connection pin).

4. Contacting the Cutting Blade and Cutting the Tape:

As the tape contacts the cutting blade, the carriage arms are engaged and the guide pins pinch the tape; the bearing is near the forward part of the third opening on the cutter arm; and the first connection pin is contacting the second end or rear side of the first opening on the lower carriage arm.

As the user begins to pull the tape material downward on the cutting blade, the tape guide pins on the end of the carriage arms continue to provide resistance to allow the tape to be cut by two fingers of one hand of the user. The resistance to cut the tape is helped by the tape guides, but also by the carriage assembly pushing against the second or rear portion of the first opening on the lower carriage arm.

After the tape is cut, the forces are released on the tape, and apparatus returns to the first or resting position.

Alternate Embodiments

Single Piece Carriage

Another embodiment contains a one piece carriage, which has integral tape guide pins and a drum, which could thereby be injection-molded, and mounted in base assembly. The cutter blade may be integral to the base or a separate steel part, and is of a V-shape. The carriage tips forward and rearward on a pivot pin, and is limited in travel by slot pin riding in slot.

In another possible embodiment, the carriage assembly is contained in a base assembly. The carriage would be retained in a rearward position by a spring, to permit the carriage pivoting forward to draw the tape, then springing rearward after the tape is cut on a cutter blade, and retained in said rearward position, an action otherwise accomplished by gravity.

In another embodiment, the upper and lower carriage arms pivots in a forward and rearward direction in relation to the stationary base. Also, the cutter arm can be uniformly integrated into the base assembly so that the upper and lower carriage arms pivots in a forward and rearward direction in relation to the stationary base.

An apparatus for dispensing and cutting a spooled material with a single hand of a user comprising: a base assembly and a carriage assembly. The base assembly comprises: a first base bracket and a second base bracket; each base bracket has a first bracket end and a second bracket end and a center bracket area; each base bracket has an arm portion extending outwardly from the center bracket area; the arm portion of each bracket having a first arm blind hole and a second arm blind hole; the base assembly further has at least one foot, which is located at each base bracket end.

The carriage assembly comprises: an upper carriage arm; the upper carriage arm has a first upper carriage arm end and a second upper carriage arm end; an upper guide pin is connected to the first upper carriage arm end; the second upper carriage arm end is connected to a rotatable bearing.

There is also a lower carriage arm with a first lower carriage arm end and a second lower carriage arm end and a center lower carriage arm end; a lower guide pin is connected to the first lower carriage arm end; the lower carriage arm end has a first lower carriage arm opening and a second lower carriage arm opening; the second lower carriage arm opening is located closer to second lower carriage arm end; the first opening of the lower carriage arm is located in between the center lower carriage arm end and the second lower carriage arm end; the first lower carriage arm opening is larger than the second lower carriage arm end opening.

The second end of the upper carriage arm has a male-type connection structure; the center lower carriage arm end has a female-type connection structure; the second end of the upper carriage arm engages the center lower carriage arm end to allow for the upper and the lower guide pins to disengage from each other.

The carriage assembly also has a cutter arm, which has a first cutter arm end and a second cutter arm end; a cutting blade is connected to the first cutter arm end; the cutter arm has a first, a second and a third cutter arm opening; the first and the second openings of the cutter arm are located between the first and second ends of the cutter arm; the third opening of the cutter arm is located at the second end of the cutter arm and has a substantially larger opening than the first cutter arm end opening and is able to allow the rotatable bearing of the upper carriage arm to slidably engage within the third cutter arm opening; an upper pin and a lower pin; the lower pin engages the second arm blind holes on each of the base brackets and the second opening of the cutter arm and the second opening of the lower carriage arm; the upper pin engages the first arm blind holes on each of the base brackets and passes through the first opening of the cutter arm and slidably engages the first opening of the lower carriage arm.

There is also a drum and a drum shaft; the drum shaft is connected to the upper carriage arm; the drum shaft lies within the drum; the drum is mounted to the center part of the lower carriage arm; the spooled material engages the drum; the spooled material passes through the upper and the lower guides; the cutter arm is fastened to the base assembly; the base assembly and the carriage assembly being engaged so that the upper and the lower carriage arms move independently of the base assembly; the first opening of the lower carriage arm and the third opening of the cutter arm help said upper and lower carriage arms to move independently of the base assembly; whereby when the spoolable material is pulled forward by the single hand of the user, the upper and lower carriage arms move from a first stationary position to at least one intermediate and forward position, and the upper and lower guides slightly disengage, wherein the bearing on the upper carriage arm slides and moves within the third opening of the cutter arm, and the lower carriage arm pivots on the lower pin; and as the user continues to pull the spoolable material towards and contacts the cutting blade, the upper and lower carriage arms contact and the upper and lower guide pins pinch the spoolable material, which provides a resistance force to allow the user to cut the spoolable material on the cutting blade with the one hand.

In another possible single-piece embodiment of the invention, the carriage assembly is integral to the base and is connected with flexible arm, so that the carriage may tip forward by virtue of flexible arm, and after the tape is cut on the cutter blade, then return to a neutral position. Another embodiment has a tub style housing, which protects the carriage/base assembly, as well as providing a means by which to better hand-hold the tape dispenser.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly, and not necessarily mechanically.

Any element in a claim that does not explicitly state "means for" performing a specific function, or "step for" performing a specific function, is not be interpreted as a "means" or "step" clause as specified in 35 U.S.C. Sec. 112, Paragraph 6. In particular, the use of "step of" in the claims herein is not intended to invoke the provisions of 35 U.S.C. Sec. 112, Paragraph 6.

The invention claimed is:

1. An apparatus for dispensing and cutting a spooled material with a single hand of a user comprising:

a base assembly and a carriage assembly;

the base assembly comprises:

a first base bracket and a second base bracket;

each base bracket has a first bracket end and a second bracket end and a center bracket area;

each base bracket has an arm portion extending outwardly from the center bracket area;

the arm portion of each bracket having a first arm blind hole and a second arm blind hole;

the base assembly further has at least one foot, which is located at each base bracket end;

the carriage assembly comprises:

an upper carriage arm;

the upper carriage arm end has a first upper carriage arm end and a second upper carriage arm end;

an upper guide pin is connected to the first upper carriage arm end;

the second upper carriage arm end is connected to a rotatable bearing;

a lower carriage arm;

the lower carriage arm has a first lower carriage arm end and a second lower carriage arm end and a center lower carriage arm end;

a lower guide pin is connected to the first lower carriage arm end;

the lower carriage arm has a first lower carriage arm opening and a second lower carriage arm opening;

the second opening of the lower carriage arm is located closer to the second end of the lower carriage arm;

the first opening of the lower carriage arm is located in between the center lower carriage arm end and the second lower carriage arm end;

the first lower carriage arm opening is larger than the second lower carriage arm opening;

a cutter arm;

the cutter arm has a first cutter arm end and a second cutter arm end;

a cutting blade is connected to the first cutter arm end;

the cutter arm has a first, a second and a third cutter arm opening;

the first and the second openings of the cutter arm are located between the first and second ends of the cutter arm;

the third opening of the cutter arm is located at the second end of the cutter arm and has a substantially larger opening than the first cutter arm end opening and allows the rotatable bearing of the upper carriage arm to slidably engage within the third cutter arm opening;

an upper pin and a lower pin;

the lower pin engages the second arm blind holes on each of the base brackets and the second opening of the cutter arm and the second opening of the lower carriage arm;

the upper pin engages the first arm blind holes on each of the base brackets and passes through the first opening of the cutter arm and slidably engages the first opening of the lower carriage arm;

a drum and a drum shaft;

the drum shaft is connected to the upper carriage arm;

the drum shaft lies within the drum;

the drum is mounted to the center part of the lower carriage arm;

the spooled material engages the drum;

the spooled material passes through the upper guide pin and lower guide pin;

the cutter arm is fastened to the base assembly;

the base assembly and the carriage assembly being engaged so that the upper and the lower carriage arms move independently of the base assembly;

the first opening of the lower carriage arm and the third opening of the cutter arm help said upper and lower carriage arms to move independently of the base assembly;

whereby when the spoolable material is pulled forward by the single hand of the user, the upper and lower carriage arms move from a first stationary position to at least one intermediate and forward position, and the upper guide pin and lower guide pin slightly disengage, wherein the bearing on the upper carriage arm slides and moves within the third opening of the cutter arm, and the lower carriage arm pivots on the lower pin; and as the user continues to pull the spoolable material towards and contacts the cutting blade, the upper and lower carriage arms contact and the upper guide pin and lower guide pin pinch the spoolable material, which provides a resistance force to allow the user to cut the spoolable material on the cutting blade with the one hand.

2. The apparatus of claim 1, wherein the base assembly further has at least one spacer, which is sandwiched in between the first and the second base brackets.

3. The apparatus of claim 1, wherein the at least one foot of the base assembly is comprised of a first foot and a second foot and at least one structure for gripping a surface underneath the base.

4. The apparatus of claim 1, wherein each bracket end has a bracket end hole.

5. The apparatus of claim 1, wherein the drum shaft has a groove at one terminal end and a ring; and the ring slidably engages and moves within the drum shaft groove.

6. An apparatus for dispensing and cutting a spooled material using a single hand of a user comprising:

a base and a carriage assembly;

the carriage assembly comprises:

an upper carriage arm;

the upper carriage arm end has a first upper carriage arm end and a second upper carriage arm end;

an upper guide pin is connected to the first upper carriage arm end;

the second upper carriage arm end is connected to a rotatable bearing;

a lower carriage arm;

the lower carriage arm has a first lower carriage arm end and a second lower carriage arm end and a center lower carriage arm end;

a lower guide pin is connected to the first lower carriage arm end;

the lower carriage arm has a first lower carriage arm opening and a second lower carriage arm opening;

the second lower carriage arm opening is located closer to second lower carriage arm end;

the first opening of the lower carriage arm is located in between the center lower carriage arm end and the second lower carriage arm end;

the first lower carriage arm opening is larger than the second lower carriage arm opening;

a cutter arm;

the cutter arm has a first cutter arm end and a second cutter arm end;

a cutting blade is connected to the first cutter arm end;

the cutter arm has a first, a second and a third cutter arm opening;

the first and the second openings of the cutter arm are located between the first and second ends of the cutter arm;

the third opening of the cutter arm is located at the second end of the cutter arm and has a substantially larger opening than the first cutter arm opening and allows the rotatable bearing of the upper carriage arm to slidably engage within the third cutter arm opening;

an upper pin and a lower pin;

the lower pin engages the base and the second opening of the cutter arm and the second opening of the lower carriage arm;

the upper pin engages the base and passes through the first opening of the cutter arm and slidably engages the first opening of the lower carriage arm;

a drum and a drum shaft;

the drum shaft is connected to the upper carriage arm;

the drum shaft lies within the drum;

the drum is mounted to the center part of the lower carriage arm;

The spooled material engages the drum;

the spooled material passes through the upper guide pin and lower guide pin;

the cutter arm is fastened to the base;

the base and the carriage assembly being engaged so that the upper and the lower carriage arms move independently of the base;

the first opening of the lower carriage arm and the third opening of the cutter arm help said upper and lower carriage arms to move independently of the base;

whereby when the spoolable material is pulled forward by the single hand of the user, the upper and lower carriage arms move from a first stationary position to at least one intermediate and forward position, and the upper guide pin and lower guide pin slightly disengage, wherein the bearing on the upper carriage arm slides and moves within the third opening of the cutter arm, and the lower carriage arm pivots on the lower pin; and as the user continues to pull the spoolable material towards and contacts the cutting blade, the upper and the lower carriage arms contact and the upper guide pin and lower guide pin pinch the spoolable material, which provides a resistance force to allow the user to cut the spoolable material on the cutting blade with the one hand.

7. The apparatus of claim 6, wherein said base further comprises at least one base bracket;

said at least one base bracket has a first bracket end and a second bracket end and a center bracket area;

said at least one base bracket has an arm portion extending outwardly from the center bracket area;

said at least one base bracket being able to securely engage the upper and the lower pins; and the base further has at least one foot and at least one structure for gripping a surface underneath the base.

8. The apparatus of claim 7, wherein the base further has at least one spacer.

9. The apparatus of claim 6, wherein the drum shaft has a groove at one terminal end and a ring; and the ring slidably engages and moves within the drum shaft groove.

10. An apparatus for dispensing and cutting a spooled material using a single hand of a user comprising:

a base and a carriage assembly;

the carriage assembly comprises:

an upper carriage arm;

the upper carriage arm has a first upper carriage arm end and a second upper carriage arm end;

an upper guide pin is connected to the first upper carriage arm end;

the second upper carriage arm end is connected to a rotatable bearing;

a lower carriage arm;

the lower carriage arm has a first lower carriage arm end and a second lower carriage arm end and a center lower carriage arm end;

a lower guide pin is connected to the first lower carriage arm end;

the lower carriage arm has a first lower carriage arm opening and a second lower carriage arm opening;

the second lower carriage arm opening is located closer to second lower carriage arm end;

the first opening of the lower carriage arm end is located in between the center lower carriage arm end and the second lower carriage arm end;

the first lower carriage arm opening is larger than the second lower carriage arm opening;

a cutter arm;

the cutter arm has a first cutter arm end and a second cutter arm end;

a cutting blade is connected to the first cutter arm end;

the cutter arm has a first, a second and a third cutter arm opening;

the first and the second openings of the cutter arm are located between the first and second ends of the cutter arm;

the third opening of the cutter arm is located at the second end of the cutter arm and has a substantially larger opening than the first cutter arm opening and allows the rotatable bearing of the upper carriage arm to slidably engage within the third cutter arm opening;

an upper pin and a lower pin;

the lower pin engages the base and the second opening of the cutter arm and the second opening of the lower carriage arm;

the upper pin engages the base and passes through the first opening of the cutter arm and slidably engages the first opening of the lower carriage arm;

a drum and a drum shaft;

the drum shaft is connected to the upper carriage arm;

the drum shaft lies within the drum;

the drum is mounted to the center part of the lower carriage arm;

the spooled material engages the drum;

the spooled material passes through the upper guide pin and lower guide pin;

the cutter arm is fastened to the base and remains relatively stationary to the base;

the second end of the upper carriage arm has a male-type connection structure;

the center lower carriage arm end has a female-type connection structure;

the second end of the upper carriage arm engages the center lower carriage arm end to allow for the upper and the lower guide pins to disengage from each other;

the upper and lower carriage arms are able to move from a first resting position to at least one intermediate position and to a third cutting position due to the first opening on the lower carriage arm and the third opening on the cutting arm;

whereby in the third cutting position, the upper and the lower carriage arms contact and the upper and the lower guide pins pinch the spoolable material and provide a resistance force to allow cutting of the spoolable material on the cutting blade using the single hand of the user.

11. The apparatus of claim 10, wherein the drum shaft has a groove at one terminal end and a ring; and the ring slidably engages and moves within the drum shaft groove.

* * * * *